US007047767B2

(12) United States Patent
Ando'

(10) Patent No.: US 7,047,767 B2
(45) Date of Patent: May 23, 2006

(54) METHOD FOR MANUFACTURING SOCKS WITH A CIRCULAR KNITTING MACHINE HAVING AT LEAST TWO FEEDS OR DROPS

(75) Inventor: Jan Ando', Scandicci (IT)

(73) Assignee: Matec S.P.A., Scandicci (IT)

( * ) Notice: Subject to any disclaimer, the term of this patent is extended or adjusted under 35 U.S.C. 154(b) by 689 days.

(21) Appl. No.: 10/385,788

(22) Filed: Mar. 11, 2003

(65) Prior Publication Data

US 2003/0172684 A1 Sep. 18, 2003

(30) Foreign Application Priority Data

Mar. 12, 2002 (IT) ..... MI2002A0525

(51) Int. Cl.
*D04B 9/46* (2006.01)

(52) U.S. Cl. ..... 66/8; 66/185

(58) Field of Classification Search ..... 66/8, 66/38, 13, 17, 216, 178 R, 125 R, 186, 187; 2/239

See application file for complete search history.

(56) References Cited

U.S. PATENT DOCUMENTS 3,142,974 A * 8/1964 Fregeolle ..... 66/48
4,037,436 A * 7/1977 Wehrmann ..... 66/186
6,000,247 A * 12/1999 Takeda et al. ..... 66/187
6,158,253 A * 12/2000 Svoboda et al. ..... 66/178 R
6,205,821 B1 * 3/2001 Sangiacomo ..... 66/38

* cited by examiner

*Primary Examiner*—Danny Worrell
(74) *Attorney, Agent, or Firm*—Welsh & Katz, Ltd.

(57) ABSTRACT

A method for manufacturing socks with a circular knitting machine having at least two feeds or drops, consisting in producing the sock starting from its opposite end with respect to the toe. The toe is produced by using at least two feeds simultaneously and by actuating the needle cylinder with an alternating rotary motion so that two sets of needles, arranged on mutually opposite sides, are made to knit respectively at one of the at least two feeds and at the other one of the at least two feeds, forming stitches simultaneously, and gradually decreasing, for a preset number of rows of stitches, the needles of the two sets that are made to knit.

10 Claims, 1 Drawing Sheet

METHOD FOR MANUFACTURING SOCKS WITH A CIRCULAR KNITTING MACHINE HAVING AT LEAST TWO FEEDS OR DROPS

BACKGROUND OF THE INVENTION

The present invention relates to a method for manufacturing socks with a circular knitting machine having at least two feeds or drops.

As is known, in the conventional production of socks with circular machines the heel and toe of the sock are formed by using a single feed or drop of the machine and by actuating the needle cylinder with an alternating rotary motion about its own axis through a rotation angle of approximately 180°, so as to make one half of the needle cylinder pass at said feed or drop. The needles of this half of the needle cylinder are made to knit at the feed or drop being considered, and their number is gradually decreased, increasing the number of needles excluded from knitting starting from the lateral ends of the set, in a first step, and gradually increased in a second step, so as to achieve the characteristic pouch-like shape for the heel and the toe.

Formation of the heel and toe of the sock, due to the need to actuate the needle cylinder with an alternating rotary motion about its own axis and at a reduced speed owing to the fact that the direction of rotation of the needle cylinder must be reversed cyclically, considerably affects the overall duration of the sock production cycle. In order to reduce the time required to form the heel and the toe of socks, methods have been proposed which allow to form a pouch at the heel and toe by actuating the cylinder with a continuous rotary motion about its own axis and by interrupting, by cutting the thread, the additional rows of stitches that provide the pouch. Although these methods unquestionably speed up the sock production cycle, they have the drawback of producing a sock that is not fully satisfactory both from an aesthetic standpoint and as regards comfort, due to the presence of the cut trailing threads on the reverse side of the sock.

Methods for producing the heel and toe have also been devised which again provide for the actuation of the needle cylinder with an alternating rotary motion about its own axis but use multiple feeds or drops of the machine, so as to produce, at each rotation in one direction or in the opposite direction of the needle cylinder, a plurality of rows of stitches so as to speed up the production of the heel or toe. These methods have the drawback that they do not provide a result that is aesthetically comparable with what can be obtained with the conventional method, and the advantage in terms of speed is only partial, since in order to involve a plurality of feeds it is necessary to increase the extent of the alternating rotation of the needle cylinder about its own axis.

SUMMARY OF THE INVENTION

The aim of the present invention is to solve the problem described above, by providing a method for manufacturing socks with a circular knitting machine having at least two feeds or drops that allows to reduce significantly the time required to form the toe.

Within this aim, an object of the invention is to provide a method that can be performed without problems in circular knitting machines, having at least two feeds or drops, of the currently commercially available type.

Another object of the invention is to provide a method that allows to produce socks that are fully satisfactory both aesthetically and in terms of comfort.

This aim and these and other objects that will become better apparent hereinafter are achieved by a method for manufacturing socks with a circular knitting machine having at least two feeds or drops, which consists in producing the sock starting from its opposite end with respect to the toe, characterized in that the toe is produced by using at least two feeds or drops of the machine simultaneously and by actuating the needle cylinder with an alternating rotary motion about its own axis so that two sets of needles, arranged on mutually opposite sides with respect to an imaginary diametrical plane that passes through the axis of the needle cylinder, are made to knit respectively at one of said at least two feeds and at the other one of said at least two feeds, forming stitches simultaneously.

BRIEF DESCRIPTION OF THE DRAWINGS

Further characteristics and advantages of the invention will become better apparent from the description of a preferred but not exclusive embodiment of the method according to the invention, illustrated only by way of non-limitative example in the accompanying drawings, wherein.

DESCRIPTION OF THE PREFERRED EMBODIMENTS

Figure 1:
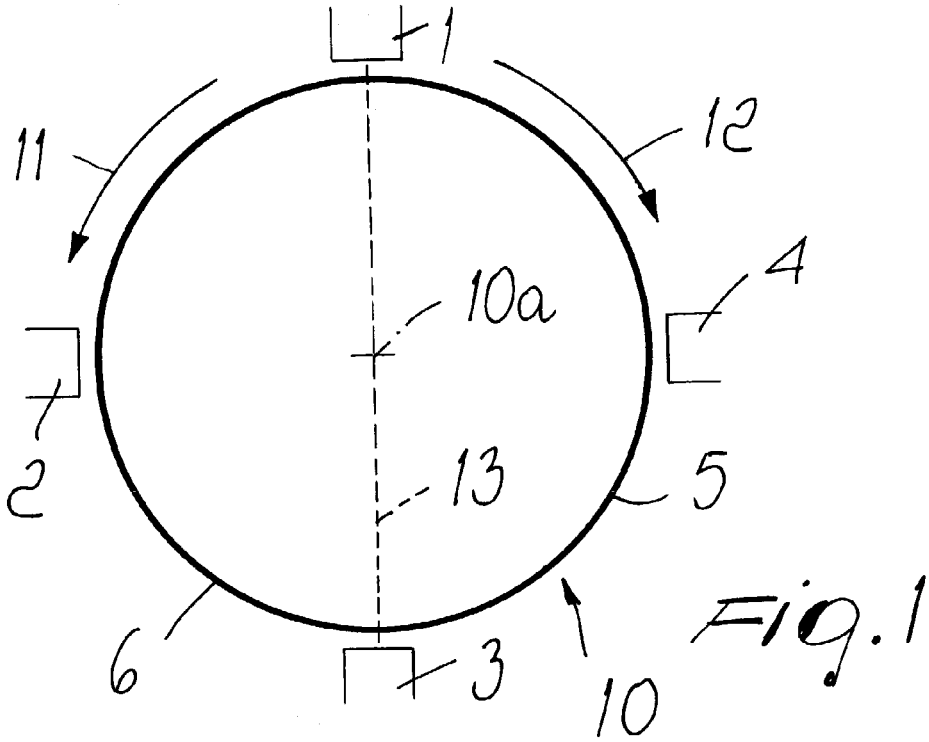
FIG. 1 is a schematic top plan view of a circular hosiery knitting machine with four feeds that can be used to perform the method according to the invention.

FIG. 1 schematically illustrates a circular hosiery knitting machine with four feeds or drops, designated by the reference numerals 1 to 4, which are distributed around the axis 10*a* of the needle cylinder 10. The method according to the invention is described with particular reference to a circular hosiery knitting machine with four feeds, of the type shown schematically in FIG. 1, without altering the fact that the same method can be performed on a machine having a smaller number of feeds but at least two feeds or drops, or a larger number of feeds or drops, as will become better apparent hereinafter.

The method consists in producing a sock, generally designated by the reference numeral 20, starting from its end 20*a* that lies opposite the toe 20*b*.

The part of the sock that extends from the end 20*a*, usually known as top, to the beginning of the toe 20*b* can be produced in a per se known manner.

According to the invention, the toe 20*b* is produced by using at least two feeds or drops of the machine simultaneously and by actuating the needle cylinder 10 with an alternating rotary motion about its axis 10*a*, so that two sets of needles 5 and 6 arranged on mutually opposite sides with respect to an imaginary diametrical plane 13 that passes through the axis 10*a* of the needle cylinder 10 are made to knit respectively at one of the two feeds and at the other one of the two feeds, forming stitches simultaneously.

Preferably, the number of needles of the two sets, which are moved to knit at the feeds being considered, is reduced gradually for a preset number of rows of stitches.

Preferably, the two feeds or drops that provide respectively the thread to the first set of needles 5 and to the second set of needles 6 to form the toe are located in positions that are substantially diametrically opposite with respect to the needle cylinder 10.

For example, with reference to FIG. 1, in order to form the toe it is possible to use the feeds 2 and 4. Assuming that the needle cylinder 10 is divided into two halves by the imaginary diametrical plane 13 so that the needles located in a first half constitute the first set of needles 5 and the needles located in the other half that constitute the second set of needles 6, the needle cylinder 10 is actuated with an alternating rotary motion about its own axis 10*a* with a rotation angle, in one direction 11 and in the other direction 12, that at the beginning of the formation of the toe 20*b* is substantially 180° or slightly more, so that all the needles of the first set 5 can pass at the feed 4, while all the needles of the second set 6 can pass at the feed 2. During the formation of the toe 20*b*, the number of needles of the first set 5 that is made to knit at the feed 4 is preferably decreased gradually, gradually excluding from knitting an increasingly larger number of needles starting from the lateral ends of the set, and likewise the number of needles of the second set 6 that are made to knit at the feed 2 is preferably gradually reduced.

In this manner, at each rotation of the needle cylinder 10 about its own axis 10*a* in the forward motion, indicated by the arrow 11, a row of stitches is formed by the set of needles 5 and simultaneously a row of stitches is formed by the set of needles 6. Likewise, a row of stitches is formed simultaneously by the first set of needles 5 and by the second set of needles 6 in the return rotation, indicated by the arrow 12, of the needle cylinder 10 about its own axis 10*a*.

Following this knitting, the toe 20*b* is constituted by two flaps, respectively a first flap 21 or upper flap produced by the first set of needles 5 and a second flap 22 or lower flap produced by the second set of needles 6. These flaps, as a consequence of the gradual reduction in the number of needles of the first set 5 and of the needles of the second set 6 made to knit at the respective feed, have a shape that tapers gradually and is preferably trapezoidal, with the longer parallel side joined to the remaining part of the item and with oblique sides that can optionally be curved or radiused at their ends.

It should be noted that in a machine with four feeds, of the type shown in FIG. 1, in order to form the toe it is possible to use all four feeds, making the first set of needles 5 knit at two contiguous feeds, for example the feeds 1 and 4, and simultaneously making the second set of needles 6 knit at the other two feeds 2 and 3. In this manner, at each forward rotation of the needle cylinder 10 about its own axis 10*a* two rows of stitches are formed by the first set of needles 5 and two rows of stitches are formed by the second set of needles 6.

The same concept can be applied on circular machines having a larger number of feeds or drops.

More generally, according to the invention, the toe can be formed by using an even number n of feeds or drops of the machine simultaneously and by actuating the needle cylinder 10 with an alternating rotary motion about its own axis so that the first set of needles 5 is made to knit at n/2 contiguous feeds and the second set of needles 6 is made to knit at the other n/2 contiguous feeds of the n feeds, forming stitches simultaneously and preferably gradually reducing, for a preset number of rows of stitches, the needles of the two sets that are made to knit at the respective feeds. In this case, at each forward or return rotation of the needle cylinder 10 about its axis 10*a*, n/2 rows of stitches are formed by the first set of needles 5 and n/2 rows of stitches are formed by the second set of needles 6.

The angle of the forward and return rotations of the needle cylinder 10 about its own axis 10*a* can be varied during the formation of the toe, so as to adapt said rotation angle to the number of needles that are made to knit at the feeds used to form the toe. In practice, by gradually reducing the number of needles that are made to knit to form the toe, because a preset number of needles is gradually excluded from knitting starting from the lateral ends of the corresponding set of needles, the rotation angle of the needle cylinder can be reduced gradually so as to match the reduction in the number of needles made to knit, allowing in any case the needles made to knit to pass in front of the feeds used.

Figure 2:
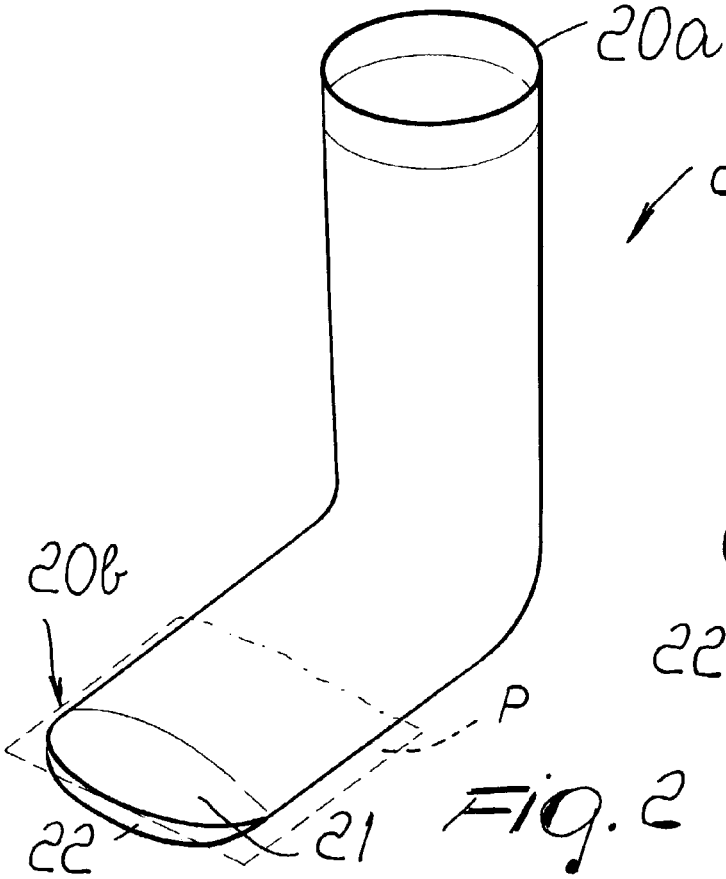
FIG. 2 is a schematic perspective view of a sock obtained with the method according to the invention before closing the toe.

The semifinished article obtained at the end of the formation of the toe has a tubular shape that has, at one of its axial ends, two, flaps 21 and 22 facing each other on mutually opposite sides with respect to an imaginary central plane (P) that passes through the axis of the article, as shown in FIG. 2. Said two flaps 21 and 22 gradually taper starting from their side joined to the remaining part of the article toward their free end.

Preferably, the two flaps 21 and 22 are substantially trapezoidal, with the longer parallel side joined to the remaining part of the article and optionally with the oblique sides curved or radiused at their ends.

Figure 3:
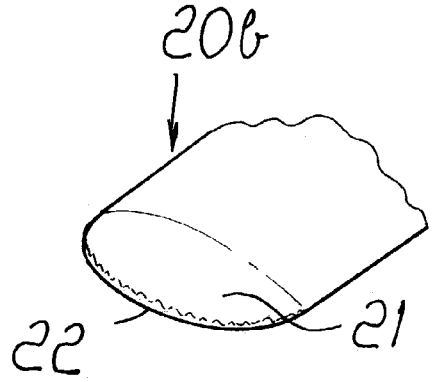
FIG. 3 is a schematic view of the toe of a sock obtained with the method according to the invention, after its closure.

The sock is completed by joining the two flaps 21 and 22 at their perimetric sides that face each other on mutually opposite sides with respect to an imaginary plane that passes through the axis of the article and through the ends of the longer parallel side that are common to the two flaps 21 and 22, except of course for the side that is joined to the remaining part of the article, as shown in FIG. 3.

The toe closing operation can be automated by providing, during the formation of the toe on the circular machine, for the retention of the last loop formed by the needles on the needles themselves and by then transferring the semifinished article, by means of a transfer device capable of picking up loop by loop the last loops formed and retained on the needles, from the machine to a toe closure device, for example as shown in Italian patent 1,277,396.

As an alternative, the closure operation might also be performed on the machine itself according to known methods, for example of the type disclosed in Italian patent 676,845, optionally with a device of the type disclosed in EPA 98010573.4.

The sock obtained with the method according to the invention has a toe with a so-called "fish-mouth" shape. A shape of this kind is known and is usually obtained by shaping and simultaneously closing an end of a tubular article by means of overcasting machines.

Differently from socks with a "fish-mouth" toe obtained with overcasting machines, the sock obtained with the method according to the invention has a toe that is shaped directly on the machine during its formation and the toe can be closed loop by loop by sewing or looping, obtaining a closure of the toe that causes no discomfort to the user.

In practice it has been found that the method according to the invention fully achieves the intended aim, since it allows to reduce significantly the time required to form the toe of the sock.

Furthermore, by leaving the possibility to close the toe by loop-by-loop sewing or by looping, the method according to the invention allows to obtain socks that are fully satisfactory both from an aesthetic standpoint and in terms of comfort.

The method thus conceived is susceptible of numerous modifications and variations, all of which are within the scope of the appended claims; all the details may further be replaced with other technically equivalent elements.

In practice, the materials used, as well as the dimensions, may be any according to requirements and to the state of the art.

The disclosures in Italian Patent Application No. MI2002A000525 from which this application claims priority are incorporated herein by reference.

What is claimed is:

1. A method for manufacturing socks with a circular knitting machine having at least two feeds or drops, a needle cylinder rotatable about an axis thereof, and two sets of needles, arranged on mutually opposite sides with respect to an imaginary diametrical plane that passes through the axis of the needle cylinder, the method comprising: producing a sock with a toe starting from an opposite end thereof with respect to the toe, the toe being produced by using the at least two feeds or drops of the machine simultaneously and by actuating the needle cylinder with an alternating rotary motion about the axis thereof so that said two needle sets are made to knit respectively at a first one of said at least two feeds and at a second one of said at least two feeds, forming stitches simultaneously.

2. The method of claim 1, comprising decreasing gradually for a preset number of rows of stitches a number of needles of said two sets of needles made to knit respectively at one and the other of said at least two feeds.

3. The method of claim 1, comprising maintaining said at least two feeds are in positions that are substantially mutually diametrically opposite with respect to the needle cylinder.

4. The method of claim 3, wherein during the formation of the toe, the needle cylinder is actuated with an alternating rotary motion about the axis thereof through an angle that is sufficient to make the needles of said two sets, made to knit, passing respectively in front of said first feed and said second feed.

5. The method of claim 4, wherein the toe is formed by using an even number n of feeds or drops of the machine simultaneously, and by actuating the needle cylinder with an alternating rotary motion about the axis thereof, so that the two sets of needles, arranged on mutually opposite sides with respect to an imaginary diametrical plane that passes through the axis of the needle cylinder, are made to knit respectively at n/2 contiguous feeds and at the other n/2 contiguous feeds of said n feeds, forming stitches simultaneously.

6. The method of claim 5, wherein during formation of the toe, the needle cylinder is actuated with an alternating rotary motion about the axis thereof through an angle that is sufficient to make needles of said two needle sets, that are made to knit, passing respectively in front of said n/2 contiguous feeds and said other n/2 contiguous feeds of said n feeds.

7. The method of claim 6, comprising operating said two set of needles which include a first set of needles for knitting an upper part of the toe and a second set of needles for knitting a lower part of the toe.

8. The method of claim 7, wherein during the formation of the toe a number of needles of said two sets of needles made to knit at the respective feeds is reduced gradually, by gradually excluding from knitting an increasingly larger number of needles starting from lateral ends of a corresponding set of needles for a preset number of rows of stitches.

9. The method of claim 8, wherein the needles retain the last loop formed and, upon ending formation of the toe, the sock is picked up mechanically from the needles of the machine, loop by loop retained by the needles, and transferred to a toe closure device.

10. The method of claim 8, wherein upon ending formation of the toe of the sock, the toe is closed on the knitting machine itself.

* * * * *